US012510073B2

(12) United States Patent
Scharer et al.

(10) Patent No.: US 12,510,073 B2
(45) Date of Patent: Dec. 30, 2025

(54) REFRIGERATION SYSTEM WITH A SCROLL MACHINE HAVING A PLATE INSERTED IN A BASE OF THE SCROLL MACHINE

(71) Applicant: BITZER KUEHLMASCHINENBAU GMBH, Sindelfingen (DE)

(72) Inventors: Christian Scharer, Gaggenau (DE); Markus Hauser, Rottenburg am Neckar-Oberndorf (DE); Klaus Feller, Herrenberg (DE)

(73) Assignee: BITZER KUEHLMASCHINENBAU GMBH, Sindelfingen (DE)

( * ) Notice: Subject to any disclaimer, the term of this patent is extended or adjusted under 35 U.S.C. 154(b) by 0 days.

(21) Appl. No.: 18/232,665

(22) Filed: Aug. 10, 2023

(65) Prior Publication Data

US 2024/0060492 A1 Feb. 22, 2024

(30) Foreign Application Priority Data

Aug. 16, 2022 (DE) ..... 102022120681.5

(51) Int. Cl.
*F04C 18/02* (2006.01)
*F04C 27/00* (2006.01)
*F04C 29/00* (2006.01)

(52) U.S. Cl.
CPC ..... *F04C 18/0215* (2013.01); *F04C 18/0246* (2013.01); *F04C 18/0253* (2013.01);
(Continued)

(58) Field of Classification Search
CPC ..... F04C 18/0215; F04C 18/0246; F04C 18/0253; F04C 18/0261; F04C 18/0269;
(Continued)

(56) References Cited

U.S. PATENT DOCUMENTS 4,498,852 A * 2/1985 Hiraga ..... F04C 18/0207 418/142
5,122,041 A * 6/1992 Yokota ..... F04C 27/005 418/140

(Continued)

FOREIGN PATENT DOCUMENTS

CN 203201801 U 9/2013
DE 3442619 A1 5/1986

(Continued)

OTHER PUBLICATIONS

Machine translation and Foreign Patent Publication for JP H071099980 A; First Inventor: Yasushi; Title: Pressure Resistant Structure in Scroll Compressor; Published Apr. 25, 1995. (Year: 1995).*

(Continued)

*Primary Examiner* — Mary A Davis
(74) *Attorney, Agent, or Firm* — Nath, Goldberg & Meyer; Jerald L. Meyer; Ilirian Durri

(57) ABSTRACT

A scroll machine, in particular a scroll compressor, has a first scroll unit with a base and a scroll rib protruding from the base with a scroll rib tip, a second scroll unit with a base and a scroll rib protruding from the base with a scroll rib tip. The first scroll unit can be moved along an orbital path relative to the second scroll unit and the first scroll unit and the second scroll unit engage with each other to form pressure chambers, and the scroll rib of a scroll rib tip having a face seal abuts sealingly to the base of the respective other scroll unit. The base of the first scroll unit and/or the base of the second scroll unit include(s) a pocket with an insert plate arranged in the pocket. Also contemplated is a refrigeration system.

18 Claims, 5 Drawing Sheets

Figure 1:
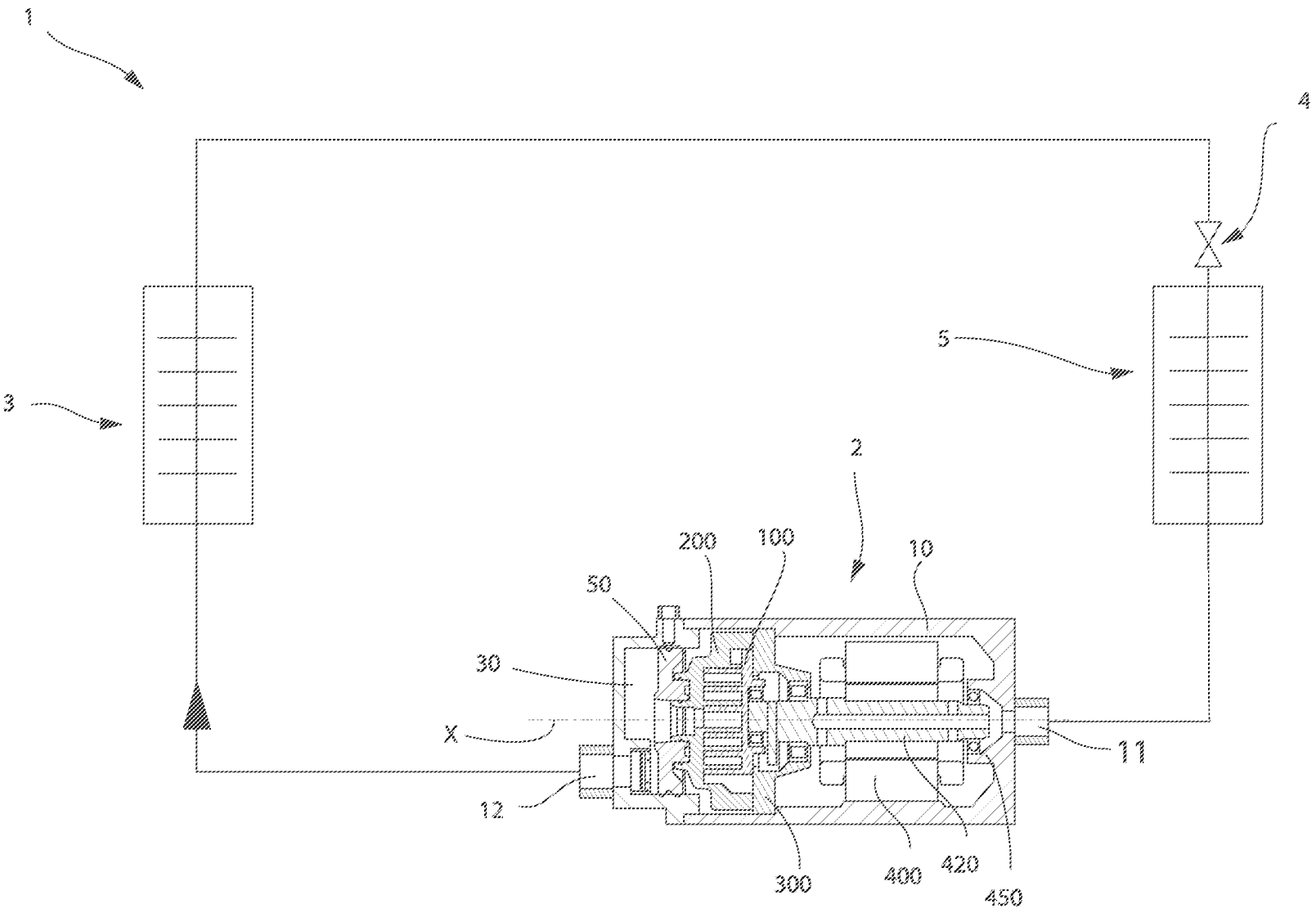

(52) U.S. Cl.
CPC ..... *F04C 18/0269* (2013.01); *F04C 18/0284* (2013.01); *F04C 27/005* (2013.01); *F04C 29/0007* (2013.01); *F04C 2240/801* (2013.01)

(58) Field of Classification Search
CPC ..... F04C 18/0284; F04C 27/005; F04C 29/0007; F04C 29/028; F04C 2240/801
See application file for complete search history.

(56) References Cited

U.S. PATENT DOCUMENTS

| | | | | | |
|---|---|---|---|---|---|
| 5,702,241 | A * | 12/1997 | Matsumoto | F04C 27/005 | 418/142 |
| 5,888,057 | A * | 3/1999 | Kitano | F04C 18/0253 | 418/55.6 |
| 6,033,194 | A * | 3/2000 | Iizuka | F04C 18/0253 | 418/142 |
| 7,815,423 | B2 * | 10/2010 | Guo | F04C 18/0215 | 418/55.1 |
| 2008/0247895 | A1 | 10/2008 | Caillat et al. | | |

FOREIGN PATENT DOCUMENTS

| | | | |
|---|---|---|---|
| DE | 69002885 | T2 | 1/1994 |
| DE | 69700165 | T2 | 9/1999 |
| DE | 69700233 | T2 | 11/1999 |
| DE | 102017102232 | A1 | 8/2017 |
| EP | 3578823 | A1 | 12/2019 |
| JP | H0388983 | A | 4/1991 |
| JP | H07269472 | A | 10/1995 |

OTHER PUBLICATIONS

Machine Translation and WIPO Publication for WO 2020/215663 A1; First Inventor: Guo; Title: Scroll Compressor; Published: Nov. 7, 2019. (Year: 2019).*

Office action issued Feb. 5, 2024, in parallel pending European patent application No. 23 181522.6.

* cited by examiner

REFRIGERATION SYSTEM WITH A SCROLL MACHINE HAVING A PLATE INSERTED IN A BASE OF THE SCROLL MACHINE

The present invention relates to a scroll machine with an injection for a medium, in particular a refrigerant, and a refrigeration system with such a scroll machine.

Scroll machines are fluid energy machines and are already known from the prior art in different configurations. Scroll machines include, for example, scroll compactors, scroll compressors/spiral compressors or scroll expanders.

Known scroll machines typically have two interacting scroll units, each with at least one scroll rib forming at least one scroll channel. The scroll ribs of the scroll units engage or intermesh to form pressure chambers, with the scroll ribs sealingly abutting the base of the respective other scroll unit.

Both the respective scroll channel and the scroll rib forming the scroll channel are formed in the form of an evolvent of a circle, with the two scroll units being movable relative to one another. A common structural design of scroll machines has a stationary scroll unit and a movable scroll unit, with the movable first scroll unit being movable along an orbital path relative to a second scroll unit.

According to the displacement principle, a medium, for example a refrigerant, is compressed or compacted in a compactor or a compressor by a relative movement of the two scroll units. During this relative movement, the medium in the pressure chambers is displaced along the scroll channels from an outer end area to an inner end area, with the medium in the respective pressure chamber undergoing a change in volume.

In an expander, the medium, in particular a refrigerant, is expanded by a relative movement of the two scroll units. During this relative movement, the medium in the pressure chambers is displaced along the scroll channels from an inner end area to an outer end area, with the medium in the respective pressure chamber undergoing an increase in volume.

WO 2018 019 372 A1, for example, describes such a generic scroll machine, which can be used in a refrigeration system with a refrigerant cycle. Such refrigeration systems can have a variety of uses, such as cooling a secondary fluid such as air, or cooling components or equipment.

The scroll machines and refrigeration systems described above have proven themselves in the past. The scroll units are exposed to high mechanical loads and compressive forces. The cyclic mechanical loads on the interacting scroll ribs have a negative effect on the intended service life of the scroll machine and require a robust and therefore heavy construction.

The sealing of the pressure chamber also poses challenges, since the contact surfaces of the scroll units are subject to wear.

This is where the present invention comes in.

It is the object of the present invention to propose a scroll machine and a refrigeration system of the type described at the outset, which eliminates the disadvantages known from the prior art in an expedient manner.

These objects are achieved by a scroll machine and a refrigeration system having features as described in this specification.

Further advantageous configurations of the invention are specified in the dependent claims.

The scroll machine according to the invention, in particular a scroll compressor, for a medium, has a first scroll unit and a second scroll unit, which are arranged in a longitudinal axis. The first scroll unit comprises a base and a scroll rib extending from the base and having a scroll rib tip. The second scroll unit comprises a base and a scroll rib extending from the base and having a scroll rib tip. The first scroll unit can be moved along an orbital path relative to the second scroll unit, and the first scroll unit and second scroll unit engage with each other to form pressure chambers with the scroll rib tip sealingly interacting with the base of the respective other scroll unit. According to the invention, it is provided that the base of the first scroll unit and/or the base of the second scroll unit comprise(s) a pocket with an insert plate arranged in the pocket.

It is already noted at this point that the medium within the meaning of the present invention is preferably a refrigerant, with the refrigerant comprising a lubricant which can be entrained by the refrigerant.

According to the present invention, an insert plate is inserted into the base of the first scroll unit and/or into the base of the second scroll unit, which has a sealing surface which interacts with the respective scroll rib tip and which the respective scroll rib tip moves over during a complete movement of the first scroll unit along the orbital path. The shape and size of the insert plate corresponds to the shape and size of the pocket.

The first scroll unit and/or the second scroll unit can be made of aluminum or an aluminum alloy, while the insert plate can be made of a harder material such as metal, stainless steel or the like. The base of the respective scroll unit is therefore subject to less wear and the insert plate can be replaced if necessary.

The respective scroll rib tip of the first scroll unit and/or the second scroll unit is preferably designed, for example by means of a face seal, which will be described later, in such a way that the respective scroll rib tip sealingly interacts during a complete movement of the first scroll unit along the orbital path exclusively within the sealing surface of the insert plate.

According to a refinement of the present invention, the insert plate is inserted loosely into the pocket. The insert plate is thus held in the pocket exclusively in a form-fitting manner. Lubricant entrained by the medium can settle between the pocket and the insert plate, which on the one hand avoids wear between the insert plate and the pocket and on the other hand lubricates the sealing surface of the insert plate, whereby an improved sealing effect between the respective scroll rib tip and the insert plate can be achieved.

In addition, it has proven to be advantageous if the pocket has a pocket depth and the insert plate has a plate thickness and the plate thickness is greater than the pocket depth. The insert plate protrudes from the pocket. Furthermore, this measure can ensure that the end face of a scroll unit cannot collide with the base of the respective other scroll unit.

The respective pocket should preferably be provided with a corner radius that is as small as possible, so that play between the insert plate and the pocket can be reduced to a minimum. This and/or the selection of suitable tolerances is intended to reduce the freedom of movement of the insert plate in the pocket to a minimum and prevent the scroll rib from being damaged by the insert plate.

According to a refinement, it can be advantageous if the pocket is arranged at a distance from the respective scroll rib. The distance between the scroll rib and the pocket of the first scroll unit and/or the second scroll unit is measured across a scroll channel formed by the scroll rib. The notch effect of the pocket can be reduced by the distance between the pocket and the scroll rib.

Furthermore, it has proven to be advantageous if a transition fillet is provided between the base and the scroll rib of the scroll unit. The fillet preferably has a radius and reduces the notch effect in the area between the base and the scroll rib.

According to a refinement, to further reduce the notch effect, the distance between the pocket and the scroll rib can approximately correspond to the radius of the transition fillet between the base and the scroll rib.

A refinement of the invention can also provide that the insert plate has at least one lubricating notch. The at least one lubricating notch connects the sealing surface to a rear side of the insert plate arranged on the opposite side and enables the lubricant entrained by the medium to penetrate through the lubricating notch into the pocket between the scroll unit and the insert plate. It is also preferred if the at least one lubricating notch is arranged on an edge of the insert plate that is on the outside in the radial direction and is designed in the direction of the longitudinal axis in the manner of a rounded groove.

As provided by a refinement of the present invention, the second scroll unit has at least one injection port for the medium from an economizer cycle. The medium from the economizer cycle can be injected through the injection port into a closed pressure chamber, which means that the operating limits of the scroll machine and the efficiency of the scroll machine can be increased.

Furthermore, according to a refinement of the present invention, it can be provided that the injection port comprises a recess in the scroll rib. The recess is preferably formed in the manner of a rounded groove in a scroll wall of the scroll rib. The recess can also extend from the base of the second scroll unit in the scroll wall of the scroll rib in the direction of the scroll rib tip over preferably more than 5% of a height of the scroll rib and preferably not more than 50% of the height, even more preferably not more than 25% of the height of the scroll rib.

Furthermore, it has proven to be advantageous if the injection port is arranged, at least in sections, in the base—preferably adjacent to the pocket.

A preferred refinement of the present invention provides that the injection port has a first port section, which is arranged in the transition fillet, and a second port section, which is formed by the recess in the scroll rib of the second scroll unit. Such an arrangement of the injection port in the transition area between the base and the scroll rib of the second scroll unit can prevent the scroll rib tip of the scroll rib of the first scroll unit or a face seal of the first scroll rib from moving over the injection port or coming into contact with the injection port. Such contact could damage both the injection port and/or the first scroll rib tip.

It has also proven to be advantageous if a supply line to the injection port in the second scroll unit is of stepped design, with the supply line tapering towards the injection port. As an alternative to the stepped supply line, the supply line can also be conical. The supply line can preferably be designed as a bore with a circular cross section. However, it is also possible to configure the supply line in cross section in the shape of a crescent or as an elongated hole.

According to a refinement or according to a further aspect of the present invention, the scroll rib tip of the first scroll unit and/or the scroll rib tip of the second scroll unit can comprise a face seal. The face seal sealing abuts the base of the other scroll unit in each case, with the face seal preferably being in active contact with the base of the other scroll unit in each case.

The face seal in connection with the present invention can be formed by a flat scroll rib tip which abuts sealingly the base of the respective other scroll unit. The face seal can have a special shape or a material composition or the like that differs from the scroll rib or can comprise a sealing body which is arranged at the tip of the scroll rib. Such sealing bodies can be made of metal or plastic, for example.

According to a refinement of the present invention, the face seal includes a groove.

Further, according to a preferred embodiment, the face seal may comprise a seal body arranged in the groove in the scroll rib tip. According to another preferred configuration of the present invention, the seal body protrudes from the groove in the scroll rib tip in the longitudinal direction.

The insert plate preferably has a sealing surface that interacts with the face seal, in particular with the sealing body, the sealing surface being dimensioned such that when the first scroll unit moves completely along the orbital path, the face seal or the sealing body moves over the respective insert plate exclusively within the sealing surface. For this purpose, the sealing surface can be dimensioned larger than the surface moved over by the face seal or the sealing body, which ensures that the face seal or the sealing body only comes into contact with the sealing surface of the insert plate and not with an outer edge of the insert plate, what would lead to damage to the face seal or the seal body and/or wear on the insert plate in the long term.

The sealing body is preferably inserted loosely into the groove, as a result of which lubricant entrained by the medium can penetrate into the groove between the sealing body and the groove. Furthermore, the medium can penetrate between the sealing body and the groove and generate an additional sealing effect of the face seal through pressure forces.

In addition, it has proven to be advantageous if the face seal is arranged between the two scroll walls on the scroll rib tip of the respective scroll rib. Furthermore, the face seal or the sealing body is preferably arranged at a distance from the scroll wall, the distance being measured along a normal vector of the scroll wall. The distance between one of the two opposite scroll walls of the scroll rib and the face seal in each case is preferably of the same size.

In addition, it has proven advantageous if the wall distance between the insert plate and the scroll wall is smaller than the distance between the scroll wall and the sealing body. This ensures that the face seal only covers the sealing surface of the insert plate and does not go beyond the sealing surface.

A further aspect of the present invention or a preferred refinement of the present invention provides that the scroll machine, in particular a scroll compressor, has a first scroll unit and a second scroll unit for a medium, which are arranged in a longitudinal axis. The first scroll unit comprises a base and a scroll rib extending from the base and having a scroll rib tip. The second scroll unit comprises a base and a scroll rib extending from the base and having a scroll rib tip. The first scroll unit can be moved along an orbital path relative to the second scroll unit, and the first scroll unit and second scroll unit engage with each other to form pressure chambers with the scroll rib tip sealingly interacting with the base of the other scroll unit. Each scroll rib extends from an inner end section to an outer end section, and at least one of the scroll rib tips of the two scroll rib tips has a face seal that comprises a groove. The groove further comprises a face seal groove section and at least one outlet groove section, wherein the at least one outlet groove section is arranged between the outer end section and/or the inner end section. The sealing body can preferably be inserted into the face sealing groove section.

The groove in the scroll rib tip thus has at least two differently designed sections, namely the face seal groove section and the at least one outlet groove section, it being possible for the face seal to be arranged exclusively in the face seal groove section. The at least two differently designed sections differ in particular by different cross-sectional areas of the groove, preferably in the depth of the groove.

The outlet groove section can be designed in the manner of a squealer tip and forms a cavity on the side facing the base of the other scroll unit, through which a gap flow can be established over the scroll rib tip. Additional pressure losses in the cavity can on the one hand reduce the gap flow and on the other hand part of the gap flow in the groove can penetrate between the groove and the seal body into the face seal groove section, which can improve the overall sealing effect of the face seal. In particular, in the inner end section, the medium can flow at high pressure via the outlet groove section into the face seal groove section and can press the seal body out of the groove against the base of the other scroll unit, resulting in the improved sealing effect and more even wear and contact pressure. An even pressure under the sealing body results in an even pressing against the corresponding sealing surface or the corresponding insert plate, which results in reduced wear on the sealing surface.

According to a preferred refinement of the present invention, the face seal groove section can have a first groove depth and the at least one outlet groove section can have a second groove depth, the first groove depth being greater than the second groove depth. Due to the different depths, the sealing body can be held in a form-fitting manner in the face sealing groove section.

A further aspect of the present invention relates to a refrigeration system having a scroll machine as described above.

Figure 2:
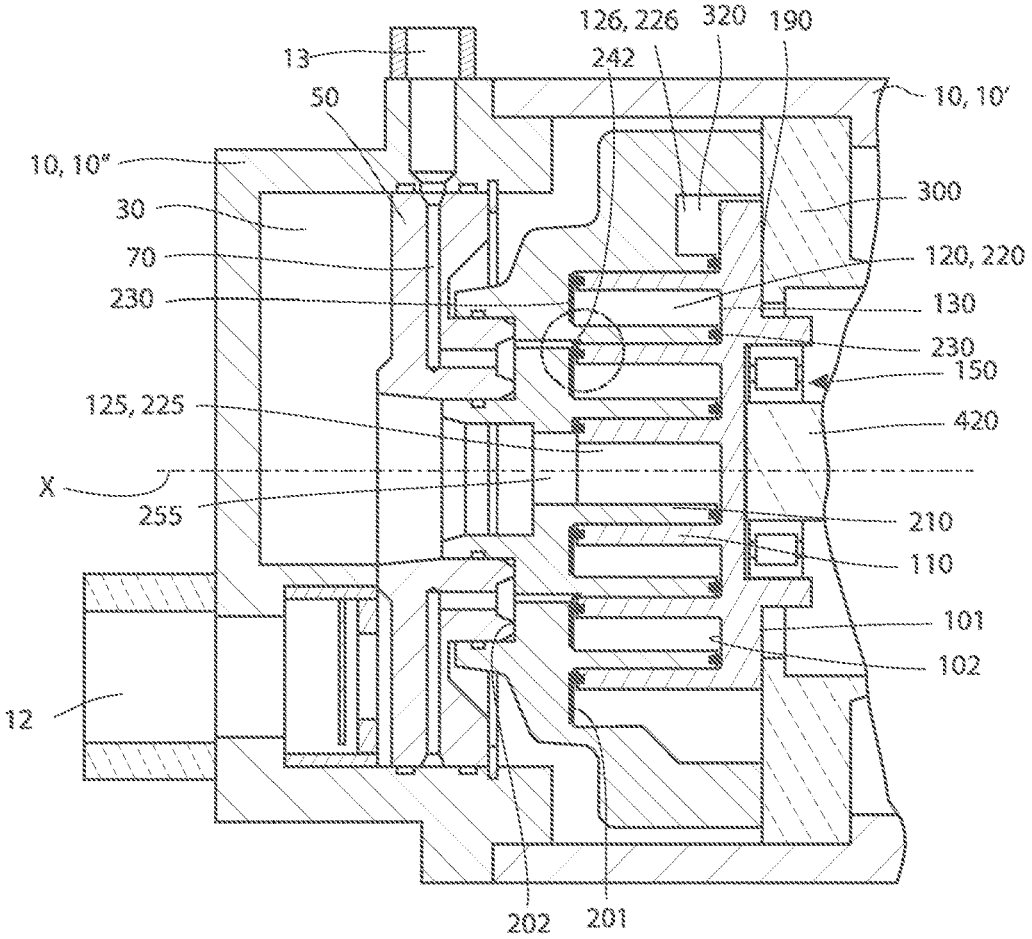
Figure 3:
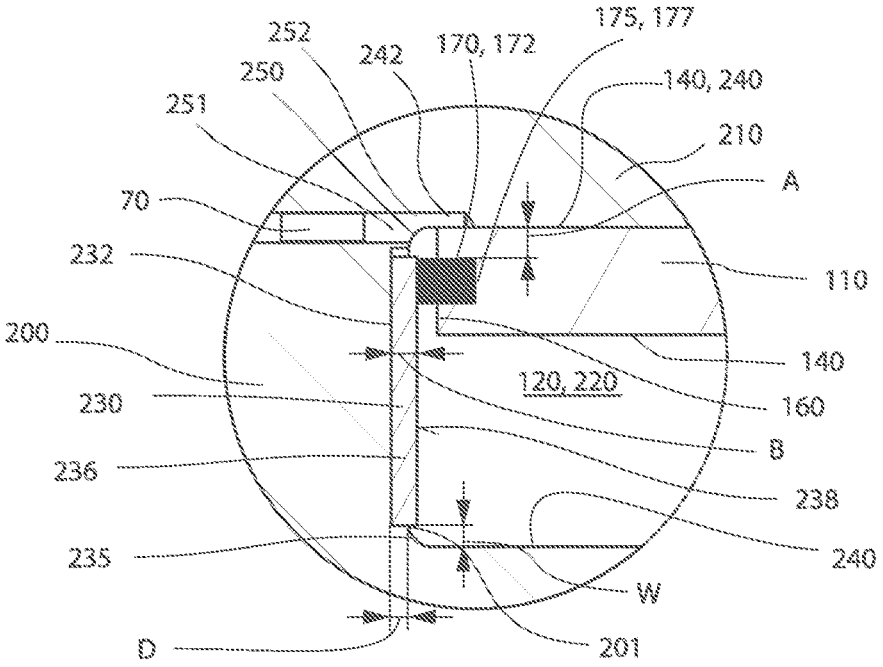
Figure 4:
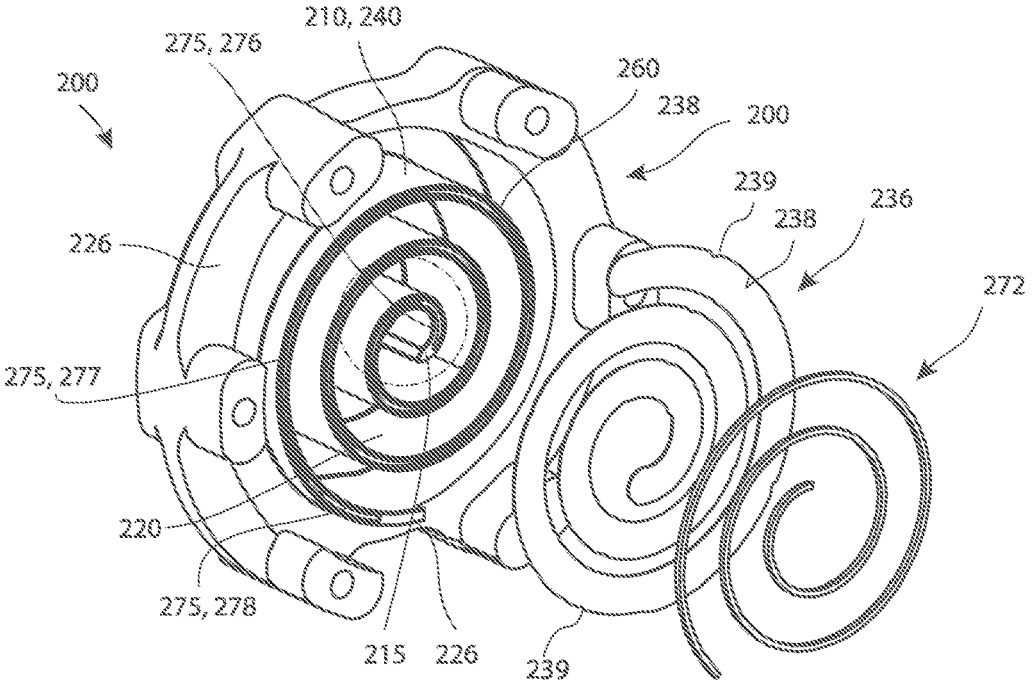
Figure 5:
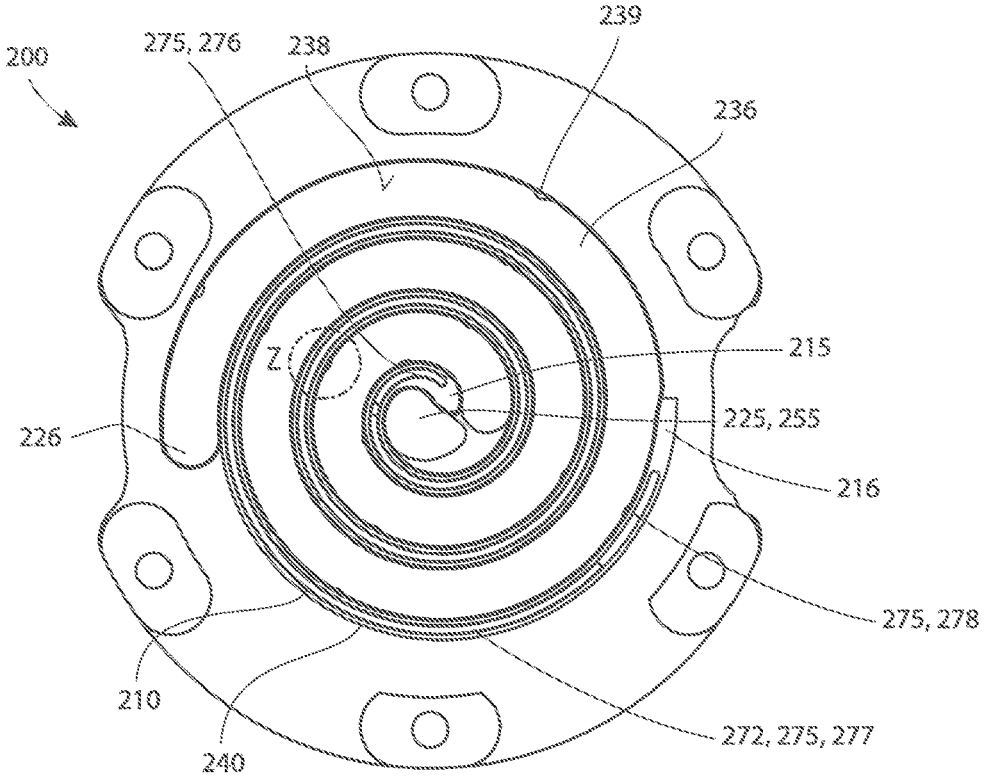
Figure 6:
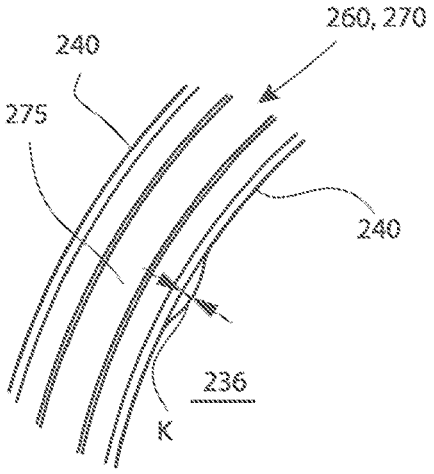
Figure 7:
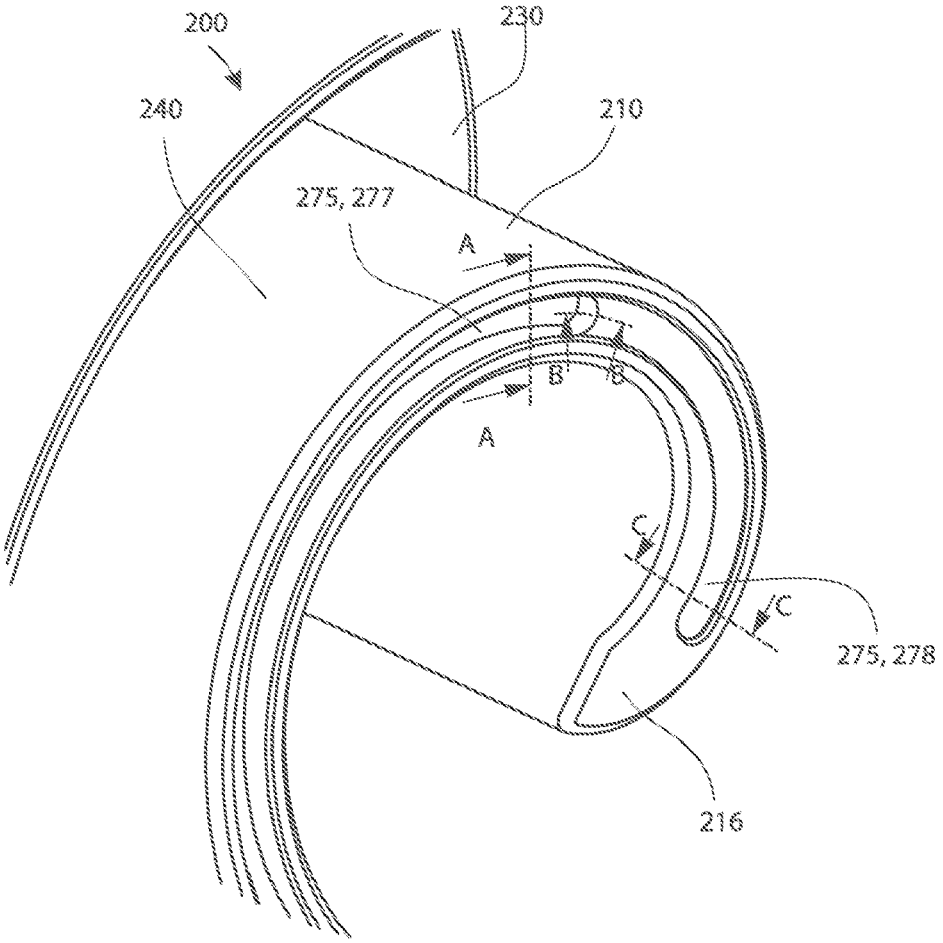
Figure 8:
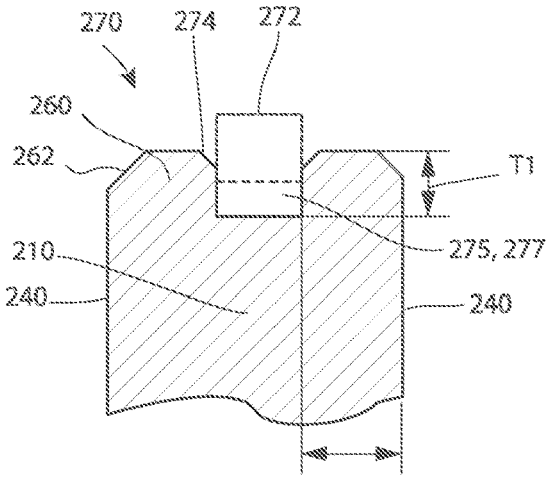
Figure 9:
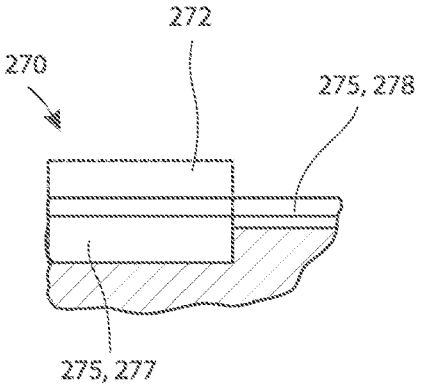
Figure 10:
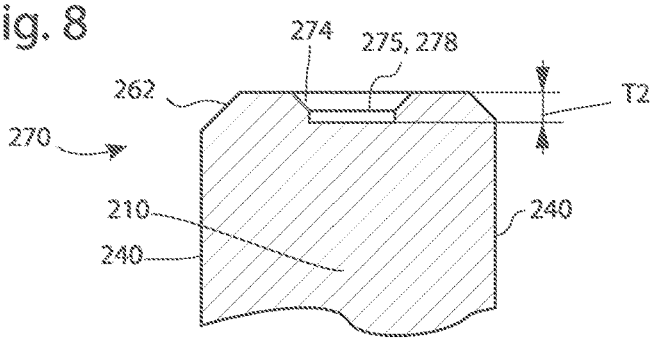
Figure 11:
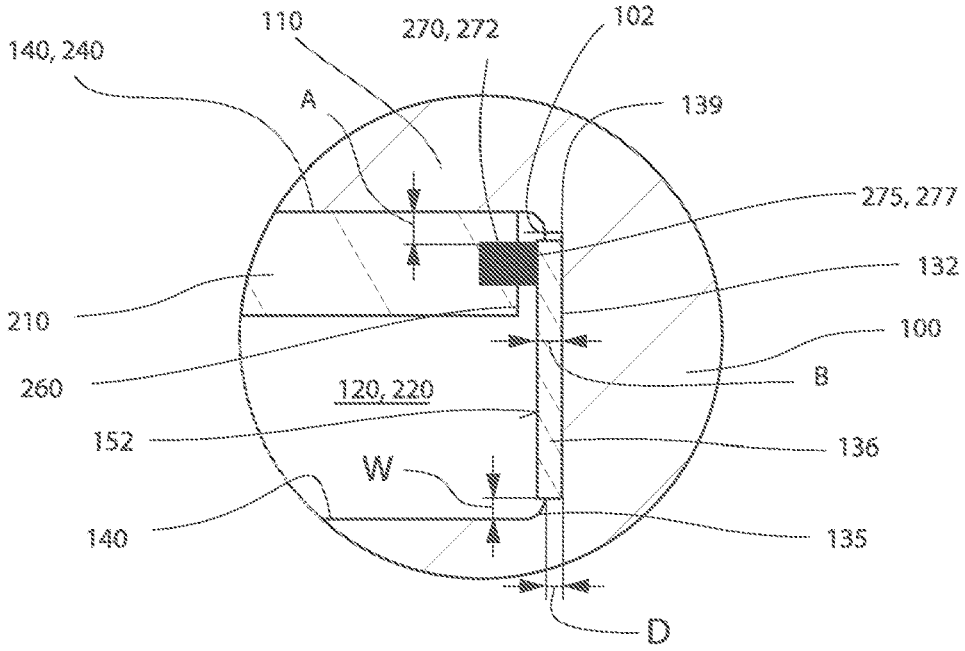

An exemplary embodiment of the present invention and a refinement thereof are described in detail below with reference to the accompanying figures. In the figures:

FIG. 1 shows a highly simplified and schematic representation of a refrigeration system with a scroll machine according to the invention, FIG. 2 shows an enlarged sectional representation of the scroll machine having a first scroll unit and a second scroll unit according to FIG. 1, FIG. 3 shows a detailed representation of the scroll machine according to FIG. 2, FIG. 4 shows a perspective exploded representation of the second scroll unit of the scroll machine according to FIG. 2 having an insert plate and a face seal, FIG. 5 shows a plan view of the second scroll unit according to FIG. 4, FIG. 6 shows an enlarged representation of detail Z according to FIG. 5, FIG. 7 shows a perspective representation of a scroll rib of the second scroll unit having a scroll rib tip, FIG. 8 shows a sectional representation along section line A-A according to FIG. 7, FIG. 9 shows a sectional representation along section line B-B according to FIG. 7, FIG. 10 shows a sectional representation along section line C-C according to FIG. 7, and FIG. 11 shows a refinement of the scroll machine, the first scroll unit of the scroll machine having an insert plate.

Identical or functionally identical parts or features are identified with the same reference numerals in the following detailed description of the figures. Furthermore, not all identical or functionally identical parts or features are provided with a reference numeral in the figures.

FIG. 1 shows a preferred embodiment of a refrigeration system 1 having a scroll machine 2. Refrigeration system 1 comprises scroll machine 2 designed as a scroll compressor, a condenser 3, an expansion element 4 and an evaporator 5. A medium, preferably a refrigerant, flows through refrigeration system 1 along the direction marked by arrows, first from an outlet 12 of scroll machine 2 in sequence to condenser 3, expansion element 4, evaporator 5 and finally back through an inlet 11 into scroll machine 2.

A simplified sectional representation of scroll machine 2 can be seen in FIG. 1. Scroll machine 2 has a machine housing 10, designated as a whole, which is oriented along a longitudinal axis X. Machine housing 10 can have a plurality of housing parts, with the machine housing 10 having a first housing part 10' and a second housing part 10" in the present exemplary embodiment.

In the machine housing 10, according to FIG. 1, inlet 11, a drive unit 400, a drive shaft 420 having a first bearing unit 450 and a second bearing unit 300, a first scroll unit 100, a second scroll unit 200, an intermediate base 50, a high-pressure chamber 30 and outlet 12 are arranged along the longitudinal axis X from right to left.

First scroll unit 100 is coupled to drive unit 400 via an eccentric drive 150 and drive shaft 420.

Drive shaft 420 is oriented in longitudinal axis X and the axis of rotation of drive shaft 420 defines longitudinal axis X in the illustrated exemplary embodiment. Drive shaft 420 has a first end section and a second end section in longitudinal axis X on opposite sides.

First scroll unit 100 according to FIG. 2 has a first side 101 and a second side 102 opposite the first side 101 in the longitudinal axis X. On first side 101, first scroll unit 100 is supported on second bearing unit 300 by means of axial bearing 190. Eccentric drive 150 is coupled to first scroll unit 100 on first side 101, and a scroll rib 110 is arranged on second side 102, which protrudes along longitudinal axis X and forms a first scroll channel 120.

Scroll rib 110 comprises scroll walls 140 and a scroll rib tip 160.

A transition fillet 135 (see FIG. 11) can be provided between scroll rib 110 and base 130. Transition fillet 135 can preferably have a radius R and serves to reduce the notch effect in a transition area between scroll rib 110 and base 130.

Furthermore, a plurality of ring-pin couplings (not shown) can be provided which prevent complete rotation of first scroll unit 100 about longitudinal axis X. The ring-pin coupling couples first scroll unit 100 to second bearing unit 300.

It can also be seen from FIG. 2 that first scroll rib 110 forms scroll channel 120 on second side 102 of first scroll unit 100. On the face side, scroll rib 110 has scroll rib tip 160, which can either have a face seal 170, as shown, or can be designed as a flat tip. First scroll channel 120 extends from an inner end area 125 to an outer end area 126.

Scroll rib 110 is formed in the form of an evolvent along a helical mean line and extends from an inner end section 115 to outer end section 116. Inner end section 115 is located radially inward relative to longitudinal axis X and outer end section 116 is located radially outward relative to longitudinal axis X. The at least one scroll channel 120 is U-shaped and is delimited in the radial directions by scroll rib 110 or scroll walls 140 of scroll rib 110 and base 130.

In the illustrated exemplary embodiment, first scroll unit 100 has a face seal 170 that projects from scroll rib tip 160 toward second scroll unit 200.

Face seal 170 comprises a groove 175 and a seal body 172 inserted into groove 175 and protruding from groove 175.

Groove 175 can—as shown in FIG. 3—preferably be arranged midway between scroll walls 140 on scroll fin tip 160 and positions seal body 172 at a distance A from scroll wall 140. Distance A preferably corresponds to a distance between scroll wall 140 and sealing body 172 or groove 175, measured along a normal vector of scroll wall 140.

Second scroll unit 200 can be stationary and has a first side 201 and a second side 202 opposite the first side 201 in the longitudinal axis X. A scroll rib 210 protrudes in the longitudinal axis X on first side 201, scroll rib 210 forming a second scroll channel 220.

Scroll rib 210 comprises scroll walls 240 and a scroll rib tip 260.

A transition fillet 235 may be provided between scroll rib 210 and base 230. Transition fillet 235 can preferably have a radius R and serves to reduce the notch effect in a transition area between scroll rib 210 and base 230.

Scroll machine 2 can have an injection that is provided for injecting the medium from an economizer cycle. For injecting the medium from an economizer cycle, second scroll unit 200 has an injection port 250 which opens into scroll channel 220 and is arranged between inner end area 125 and outer end area 126.

The medium from the economizer cycle can be injected into a closed pressure chamber through injection port 250, as a result of which the efficiency of scroll machine 2 can be increased.

In particular, the enlarged representation according to FIG. 3 shows that injection port 250 includes a recess 242 in scroll rib 210 or in scroll wall 240. Recess 242 can be designed as a rounded groove and extends in scroll wall 240 from base 230 in the direction of scroll rib tip 260, it being clear that recess 242 does not extend to scroll rib tip 260, but is formed only over approx. 10% of the channel height of second scroll channel 220.

It can also be seen from FIG. 3 that injection port 250 extends to transition fillet 235 between base 230 and scroll rib 210 and has a first port section 251 in transition fillet 235 and a second port section 252 in scroll rib 210, which is formed by recess 242 in scroll rib 210. In this way, injection port 250 can be positioned in such a way that, in particular, face seal 170 on scroll rib tip 160 of first scroll unit 100 is not routed over injection port 250 during the orbital movement. As a result, damage to both injection port 250 and/or face seal 170 of first scroll unit 100 can be avoided.

On the face side, scroll rib 210 has scroll rib tip 260 which—as shown—can have a face seal 270. Alternatively, scroll rib tip 260 may be formed as a flat tip. Furthermore, second scroll channel 220 can have an inner end area 225 and/or an outer end area 226.

Scroll rib 210 of second scroll unit 200 is adapted to scroll rib 110 of first scroll unit 100. Scroll rib 210 of second scroll unit 200 is formed in the form of an evolvent along a scroll mean line and extends from an inner end section 215 to the outer end section 216. The mean line corresponds to a profile centerline of scroll rib 210 and is located midway between the two scroll walls 240. Relative to the longitudinal axis X, inner end section 215 is located radially on the inside, and relative to the longitudinal axis X, outer end section 216 is located radially on the outside. The at least one scroll channel 220 is U-shaped and is delimited in the radial directions by scroll rib 210 or scroll walls 240 of scroll rib 210 and base 230.

In the exemplary embodiment shown according to FIG. 2, second scroll unit 200 also has a face seal 270 which protrudes from scroll rib tip 260 in the direction of first scroll unit 100. Face seal 270 comprises a groove 275 and a seal body 272 inserted into groove 275 and protruding from groove 275.

It should be noted that face seal 170 of first scroll unit 100 and face seal 270 of second scroll unit 200 may be of identical construction. For the sake of simplicity, face seal 270 of second scroll unit 200 is described below with reference to FIGS. 7 to 10.

Groove 275 comprises a face seal groove section 277, into which seal body 272 can preferably be inserted loosely, and at least one outlet groove section 276, 278, the at least one outlet groove section 278 being arranged between outer end section 216 and/or inner end section 215.

In the illustrated embodiment, groove 275 comprises two outlet groove sections 276, 278, with the face seal groove section 277 being arranged between the two outlet groove sections 276, 278.

According to FIG. 8, face seal groove section 277 has a first groove depth T1. Outlet groove section 278 in outer end section 216 according to FIG. 10 has a second groove depth T2. Outlet groove section 276, not shown in FIG. 8, in inner end section 215 has a second groove depth T3. Second groove depth T2 or T3 of outlet groove sections 276, 278 in outer end section 216 and in inner end section 215 can be dimensioned differently.

First groove depth T1 of face seal groove section 277 is greater than second groove depth T2 of outlet groove sections 276, 278, and a step shown in FIG. 9 is formed between face seal groove sections 277 and the respective outlet groove section 276, 278.

The step delimits face seal groove section 277 and positively holds seal body 272 in face seal groove section 277 in a form-fitting manner.

Outlet groove section 276, 278 forms a cavity on the side of scroll rib tip 260 facing base 130 of first scroll unit 100, through which a gap flow over scroll rib tip 260 can be established. Additional pressure losses in the cavity can, on the one hand, reduce the gap flow and, on the other hand, part of the gap flow in groove 275 can penetrate between groove 275 and seal body 272 into face seal groove section 277, as a result of which the overall sealing effect of face seal 270 can be improved. In particular, in inner end section 215 of scroll rib 210, the medium can flow at high pressure via outlet groove section 276 into the face seal groove section and can press seal body 272 out of groove 275 against base 130 of the scroll unit 100, resulting in the improved sealing effect.

According to FIGS. 8 and 10, scroll rib tips 160, 260 of first scroll unit 100 and/or second scroll unit 200 can have a chamfer 162, 262 which connects scroll rib tips 160, 260 to respective scroll wall 140, 240. Grooves 175, 275 can also have a chamfer 174, 274.

According to FIGS. 2 and 3, base 230 of second scroll unit 200 can comprise a pocket 232 and an insert plate 236. Pocket 232 is formed in first side 201 of second scroll unit 200.

Pocket 232 has a pocket depth D, see FIG. 3. It can be seen from FIGS. 4 and 5 that pocket 232 extends from inner end area 225 to outer end areas 226 of scroll channel 220 and along scroll channel 200 extends beyond a surface, which corresponds at least to the surface that face seal 170 or sealing body 172 of scroll rib 110 of first scroll unit 100 moves over during a movement along the orbital path.

Pocket 232 is arranged at a wall distance W from scroll rib 210 or scroll wall 240. Wall distance W preferably corresponds to a distance between scroll wall 240 and pocket 232, measured along a normal vector of scroll wall 240.

Wall distance W preferably corresponds approximately to radius R of transition fillet 235, which is arranged relative to scroll rib 210 or scroll wall 240.

Insert plate 236 is inserted into pocket 232 and is adapted to pocket 232 in terms of shape and size. Insert plate 236 has a plate thickness B. Furthermore, insert plate 236 has a peripheral outer edge that forms a lateral surface and connects the two end faces of insert plate 236.

Insert plate 236 preferably is loosely arranged in pocket 232. A gap can be formed between the lateral surface and pocket 232. The gap is kept as small as possible in order to avoid unnecessary relative movements between scroll unit 200 and insert plate 236.

One end face of insert plate 236 forms a sealing surface 238 on the side facing first scroll unit 100. The other end face abuts pocket 232.

It can be seen from FIGS. 3 to 5 that insert plate 236 can have a number of lubricating notches 239. Lubricating notches 239 can be formed in the lateral surface in the manner of an axially oriented rounded groove and connect the two end faces of insert plate 236.

According to FIG. 6, lubricating notch 239 can have a notch depth K. Lubricant entrained by the medium can penetrate into pocket 232 through lubricating notches 239 and lubricate the contact surfaces between the insert plate metal and pocket 232.

Also, a lubricating notch 239 may be located immediately adjacent injection port 250 as shown in FIG. 3.

It can be seen from FIG. 3 that insert plate 236 protrudes from pocket 232 and protrudes from the first side of second scroll unit 200. The pocket depth D is consequently smaller than plate thickness B. The dimensions of the pocket depth and the plate thickness B are preferably selected in such a way that insert plate 236 protrudes slightly from first side 201. This overhang is preferably as small as possible in order to achieve high efficiency and to ensure operational reliability. The plate thickness can be selected accordingly to adjust the axial play.

As shown in FIG. 2, scroll rib 110 of first scroll unit 100 and scroll rib 210 of second scroll unit 200 engage with each other or intermesh. First scroll unit 100 can be moved by drive unit 400 along an orbital path (not shown) relative to second scroll unit 200, with ring-pin coupling 350 preventing first scroll unit 100 from rotating about longitudinal axis X when moving along the orbital path.

When engaging with each other or intermeshing, scroll rib 110 of first scroll unit 100 engages the second scroll channel of second scroll unit 200 and scroll rib 210 of second scroll unit 200 engages the first scroll channel of first scroll unit 100. Scroll rib tip 260 or face seal 270 of scroll rib 210 of second scroll unit 200 interacts sealingly with base 130 of first scroll unit 100 and scroll rib tip 160 or face seal 170 of scroll rib 110 of first scroll unit 100 interacts with base 230 of second scroll unit 200.

Specifically, face seal 170, in particular sealing body 172 of first scroll unit 100, moves over sealing surface 238 of insert plate 236 of base 230 of second scroll unit 200 and for this purpose, as shown in FIG. 3, comes into operative contact with sealing surface 238 of insert plate 236.

Insert plate 236 and consequently also pocket 232 are dimensioned such that face seal 170, in particular sealing body 172, comes into operative contact with base 230 of second scroll unit 200 only with the insert plate 236 within sealing surface 238. For this purpose, the distance A between scroll wall 140 and face seal 170 or sealing body 172 is greater than wall distance W between scroll wall 140 and insert plate 236 or its outer edge.

The medium enters machine housing 10 through inlet 11 and is routed in machine housing 10 from inlet 11 to outer end areas 126, 226.

In a compressor or compactor, when first scroll unit 100 moves along the orbital path, pressure chambers (not shown) are enclosed between first scroll unit 100 and second scroll unit 200, which pressure chambers shift medium from outer end areas 126, 226 to inner end areas 125, 225 of scroll channels 120, 220. Outer end areas 126, 226 together form suction area 320, from which the medium can be sucked into scroll channels 120, 220, in order to then shift it in closed pressure chambers (not shown) from outer end area 126, 226 to inner end area 125, 225, the pressure chambers undergoing a continuous reduction in volume.

In an expander, when first scroll unit 100 moves along the orbital path, pressure chambers (not shown) are enclosed between first scroll unit 100 and second scroll unit 200, which pressure chambers shift medium from inner end areas 125, 225 to outer end areas 126, 226 of scroll channels 120, 220, the pressure chambers undergoing a continuous increase in volume.

High-pressure chamber 30 and intermediate base 50 are arranged on second side 202 of second scroll unit 200, the intermediate base 50 being arranged along longitudinal axis X between high-pressure chamber 30 and second scroll unit 200.

Second scroll unit 200 can be supported on the intermediate base 50 via a radial bearing section.

Furthermore, a supply line 70 can be routed through the intermediate base 50, which connects injection port 250 to housing port 13.

Intermediate base 50 decouples second scroll unit 200 from the pressure forces in high-pressure chamber 30 and is supported in relation to machine housing 10.

High-pressure chamber 30 is connected to second scroll channel 220 via a passage 255, passage 255 comprising an outlet port which is arranged in the area of inner end areas 125, 225. The outlet port, also known as the "discharge port", is preferably formed in inner end area 225 of base 230 of second scroll unit 200 and passage 255 extends along longitudinal axis X through an opening through intermediate base 50 to high-pressure chamber 30.

High-pressure chamber 30 is in turn connected to outlet 12 and the medium can leave scroll machine 2 through outlet 12. FIG. 11 shows a refinement of scroll machine 2 according to FIG. 2, wherein first scroll unit 100 also has a pocket 132 with an insert plate 136. Pocket 132 and insert plate 136 of first scroll unit 100 can be designed identically to pocket 232 with insert plate 236. First scroll unit 100 preferably has no injection port for the medium of the ecomizer cycle. All other features are identical.

LIST OF REFERENCE NUMERALS

1 refrigeration system
2 scroll machine
3 condenser
4 expansion organ
5 evaporator
10 machine housing
10' first housing part

10" second housing part
11 inlet
12 outlet
30 high-pressure chamber
50 intermediate base
70 line
100 first scroll unit
101 first side
102 second side
110 scroll rib
115 inner end section
116 outer end section
120 scroll channel
125 inner end area
126 outer end area
130 base
132 pocket
135 transition fillet
136 insert plate
138 sealing surface
139 lubricating notch
140 scroll wall
150 eccentric drive
160 scroll rib tip
170 face seal
172 seal body
175 groove
176 outlet groove section
177 face seal groove section
178 outlet groove section
190 axial bearing
200 second scroll unit
201 first side
202 second side
210 scroll rib
215 inner end section
216 outer end section
220 scroll channel
225 inner end area
226 outer end area
230 base
232 pocket
235 transition fillet
236 insert plate
238 sealing surface
239 lubricating notch
240 scroll wall
242 recess
250 injection port
251 first port section
252 second port section
255 passage
260 scroll rib tip
270 face seal
272 seal body
275 groove
276 outlet groove section
277 face seal groove section
278 outlet groove section
300 second bearing unit
320 suction area
400 drive unit
420 drive shaft
450 first bearing unit
A distance
D pocket depth
B plate thickness
W wall distance
T1 groove depth
T2 groove depth
X longitudinal axis

The invention claimed is:

1. A scroll machine (2), having a first scroll unit (100) with a first base (130) and a first scroll rib (110) protruding from the first base (130) with a first scroll rib tip (160), a second scroll unit (200) with a second base (230) and a second scroll rib (210) protruding from the second base (230) with a second scroll rib tip (260), wherein the first scroll unit (100) can be moved along an orbital path relative to the second scroll unit (200), and the first scroll unit (100) and the second scroll unit (200) engage with each other to form pressure chambers, the first scroll rib tip (160) of the first scroll rib (110) sealingly interacts with the second base (230) of the second scroll unit (200), and the second scroll rib tip (260) of the second scroll rib (210) sealingly interacts with the first base (130) of the first scroll unit (100), characterized in that the first base (130) of the first scroll unit (100) comprises a first pocket (132) with a first insert plate (136) arranged in the first pocket (132), and the second base (230) of the second scroll unit (200) comprises a second pocket (232) with a second insert plate (236) arranged in the second pocket (232), wherein the first pocket (132) is arranged along a first scroll channel (120), the first scroll channel (120) being formed by the first scroll rib (110), the first pocket (132) is spaced apart by a wall distance (W) from the first scroll rib (110), the wall distance (W) separating the first pocket (132) from the first scroll rib (110) being greater than zero, and the wall distance (W) between the first scroll rib (110) and the first pocket (132) of the first scroll unit (100) is measured across the first scroll channel (120), and wherein the second pocket (232) is arranged along a second scroll channel (220), the second scroll channel (220) being formed by the second scroll rib (210), the second pocket (232) is spaced apart by a wall distance (W) from the second scroll rib (210), the wall distance (W) separating the second pocket (232) from the second scroll rib (210) being greater than zero, and the wall distance (W) between the second scroll rib (210) and the second pocket (232) of the second scroll unit (200) is measured across the second scroll channel (220).

2. The scroll machine (2) according to claim 1, characterized in that the first insert plate (136) is loosely inserted in the first pocket (132), and the second insert plate (236) is loosely inserted in the second pocket (232).

3. The scroll machine (2) according to claim 1, characterized in that each one of the first and second the pockets (132, 232) has a pocket depth (D), that each one of the first and second insert plates (136, 236) has a plate thickness (B), and that the plate thickness (B) is greater than the pocket depth (D) for each one of the first and second pockets (132, 232).

4. The scroll machine (2) according to claim 1, characterized in that a first transition fillet (135) is provided between the first base (130) and the first scroll rib (110), and a second transition fillet (235) is provided between the second base (230) and the second scroll rib (210).

5. The scroll machine (2) according to claim 4, characterized in that the first wall distance (W) corresponds approximately to a first radius (R) of the first transition fillet (135), and the second wall distance (W) corresponds approximately to a second radius (R) of the second transition fillet (235).

6. The scroll machine (2) according to claim 4, characterized in that the second scroll unit (200) has a first injection port (250) for a medium from an economizer cycle, and the first injection port (250) has a first port section (251) in the second transition fillet (235) and a second port section (252) in the scroll rib (210).

7. The scroll machine (2) according to claim 1, characterized in that the second insert plate (236) has at least one lubricating notch (239).

8. The scroll machine (2) according to claim 1, characterized in that the second scroll unit (200) has at least one injection port (250) for a medium from an economizer cycle.

9. The scroll machine (2) according to claim 8, characterized in that the at least one injection port (250) comprises a recess (242) in the second scroll rib (210) of the second scroll unit (200).

10. The scroll machine (2) according to claim 1, characterized in that the first scroll rib (110) of the first scroll unit (100) comprises a first face seal (170) and/or the second scroll rib (210) of the second scroll unit (200) comprises a second face seal (270).

11. The scroll machine (2) according to claim 10, characterized in that the first insert plate (136) has a first sealing surface (138) which interacts with the second face seal (270), the second insert plate (236) has a second sealing surface (238) which interacts with the first face seal (170), and that the first and second sealing surface (138, 238) are dimensioned such that in a complete movement of the first scroll unit (100) along the orbital path, the first and second face seals (170, 270) cover the respective first and second insert plates (136, 236) within the first and second sealing surfaces (138, 238).

12. The scroll machine (2) according to claim 10, characterized in that the first face seal (170) comprises a first seal body (172) arranged in a first groove (175), and the second face seal (270) comprises a second seal body (272) arranged in a second groove (275).

13. The scroll machine (2) according to claim 10, characterized in that the first face seal (170) is arranged centrally on the first scroll rib tip (160), and the second face seal (270) is arranged centrally on the second scroll rib tip (260).

14. The scroll machine (2) according to claim 10, characterized in that the first face seal (170) is arranged at a distance (A) from a first scroll wall (140) of the first scroll rib (110,), the second face seal (270) is arranged at a distance (A) from a second scroll wall (240) of the second scroll rib (210), the distance (A) to the first scroll wall (140) is greater than a wall distance (W) between the first pocket (132) and the first scroll wall (140), and the distance (A) to the second scroll wall (240) is greater than a wall distance (W) between the second pocket (232) and the second scroll wall (240).

15. The scroll machine (2) according to claim 1, characterized in that the first scroll rib (110) extends from a first inner end section (115) to a first outer end section (116), the second scroll rib (210) extends from a second inner end section (215) to a second outer end section (216), a first groove (175) is arranged between the first inner end section (115) and the first outer end section (116), a second groove (275) is arranged between the second inner end section (215) and the second outer end section (216), the first groove (175) comprises a first face seal groove section (177) receiving a first seal body (172) and at least one first outlet groove section (176, 178,), the at least one first outlet groove section (176, 178) being arranged between the first face seal groove section (177) and the first inner end section (115, 215) and/or between the first face seal groove section (177) and the first outer end section (116), and the second groove (275) comprises a second face seal groove section (277) receiving a second seal body (272) and at least one second outlet groove section (276, 278), the at least one second outlet groove section (276, 278) being arranged between the second face seal groove section (277) and the second inner end section (215) and/or between the second face seal groove section (277) and the second outer end section (216).

16. The scroll machine (2) according to claim 15, characterized in that the at least one first outlet groove section (176, 178) has a second groove depth (T2, T3), and the second groove depth (T2, T3) of the at least one first outlet groove section (176, 178) is smaller than a first groove depth (T1) of the first face seal groove section (177), and the at least one second outlet groove section (276, 278) has a second groove depth (T2, T3), and the second groove depth (T2, T3) of the at least one second outlet groove section (276, 278) is smaller than a first groove depth (T1) of the second face seal groove section (277).

17. A refrigeration system (1) with a scroll machine (2) according to claim 1.

18. A scroll machine (2), having a first scroll unit (100) with a first base (130) and a first scroll rib (110) protruding from the first base (130) with a first scroll rib tip (160), a second scroll unit (200) with a second base (230) and a second scroll rib (210) protruding from the second base (230) with a second scroll rib tip (260), wherein the first scroll unit (100) can be moved along an orbital path relative to the second scroll unit (200), and the first scroll unit (100) and the second scroll unit (200) engage with each other to form pressure chambers, the first scroll rib tip (160) of the first scroll rib (110) sealingly interacts with the second base (230) of the second scroll unit (200), and the second scroll rib tip (260) of the second scroll rib (210) sealingly interacts with the first base (130) of the first scroll unit (100), characterized in that the first scroll rib (110) of the first scroll unit (100) comprises a first face seal (170) and the second scroll rib (210) of the second scroll unit (200) comprises a second face seal (270), the first face seal (170) comprises a first seal body (172) arranged in a first groove (175), and the second face seal (270) comprises a second seal body (272) arranged in a second groove (275), the first scroll rib (110) extends from a first inner end section (115) to a first outer end section (116), the second scroll rib (210) extends from a second inner end section (215) to a second outer end section (216), the first groove (175) is arranged between the first inner end section (115) and the first outer end section (116), the second groove (275) is arranged between the second inner end section (215) and the second outer end section (216), the first groove (175) comprises a first face seal groove section (177) receiving the first seal body (172) and at least one first outlet groove section (176, 178), the at least one first outlet groove section (176, 178) being arranged between the first face seal groove section (177) and the first inner end section (115, 215) and/or between the first face seal groove section (177) and the first outer end section (116), and the second groove (275) comprises a second face seal groove section (277) receiving the second seal body (272) and at least one second outlet groove section (276, 278), the at least one second outlet groove section (276, 278) being arranged between the second face seal groove section (277) and the second inner end section (215) and/or between the second face seal groove section (277) and the second outer end section (216), the at least one first outlet groove section (176, 178) has a second groove depth (T2, T3), and the second groove depth (T2, T3) of the at least one first outlet groove section (176, 178) is smaller than a first groove depth (T1) of the first face seal groove section (177), wherein a first step is formed between the second groove depth (T2, T3) of the at least one first outlet groove section (176, 178) and the first groove depth (T1) of the first face seal groove section (177), said first step delimits the first face seal groove section (177) and holds the first seal body (172) in a form-fitting manner within the first face seal groove section (177) such that the first seal body (172) does not extend into any one of the first outlet groove section (176, 178), and the at least one second outlet groove section (276, 278) has a second groove depth (T2, T3), and the second groove depth (T2, T3) of the at least one second outlet groove section (276, 278) is smaller than a first groove depth (T1) of the second face seal groove section (277), wherein a second step is formed between the second groove depth (T2, T3) of the at least one second outlet groove section (276, 278) and the first groove depth (T1) of the second face seal groove section (277), said second step delimits the second face seal groove section (277) and holds the second seal body (272) in a form-fitting manner within the second face seal groove section (277) such that the second seal body (272) does not extend into any one of the second outlet groove section (276, 278).

* * * * *